US006162747A

United States Patent [19]

Matsumoto et al.

[11] Patent Number: 6,162,747

[45] Date of Patent: Dec. 19, 2000

[54] FLAME RETARDANT CLOTH

[75] Inventors: Takaharu Matsumoto, Takasago; Masayuki Adachi; Takahiro Ogawa, both of Kobe; Akio Konishi, Kakogawa, all of Japan

[73] Assignee: Keneka Corporation, Osaka, Japan

[21] Appl. No.: 09/147,256

[22] PCT Filed: May 12, 1997

[86] PCT No.: PCT/JP97/01594

§ 371 Date: Nov. 10, 1998

§ 102(e) Date: Nov. 10, 1998

[87] PCT Pub. No.: WO97/43474

PCT Pub. Date: Nov. 20, 1997

[30] Foreign Application Priority Data

May 13, 1996 [JP] Japan ..... 8-117863

[51] Int. Cl.[7] ..... D03D 15/00; D03D 15/12

[52] U.S. Cl. ..... 442/197; 442/202; 428/364; 428/372; 428/373; 428/921

[58] Field of Search ..... 442/197, 202; 428/921, 364, 372, 373

[56] References Cited

U.S. PATENT DOCUMENTS

| | | | |
|---|---|---|---|
| 4,127,698 | 11/1978 | Shimizu et al. | 428/373 |
| 4,863,797 | 9/1989 | Ichibori et al. | 428/359 |
| 5,348,796 | 9/1994 | Ichibori et al. | 428/224 |

FOREIGN PATENT DOCUMENTS

| | | |
|---|---|---|
| 52-99399 | 8/1977 | Japan . |
| 53-10745 | 1/1978 | Japan . |
| 53-6617 | 1/1978 | Japan . |
| 61-89339 | 5/1986 | Japan . |

*Primary Examiner*—Blaine Copenheaver
*Assistant Examiner*—John J. Guarriello
*Attorney, Agent, or Firm*—Armstrong, Westerman, Hattori, McLeland & Naughton

[57] ABSTRACT

A flame retardant cloth, used for example in interiors as a material for curtains, comprises (A) 60–40 parts by weight of fiber which contains 8–70 wt. % of halogen chemically bonded to a polymer and 1–8 wt. % of Sb compound not chemically bonded to a polymer, and has a shirnkage factor at 240° C. of not less than 40% under a load of 300 mg/metric count yarn count (17), and (B) 60–40 parts by weight of polyester fiber, which compounded making a total of 100 parts by weight. This cloth can retain its high fire retardance even after it has been subjected to a process using a binder, such as pigment printing, and enables the range of application of a compound flame retadant fiber product comprising polyester fiber and halogen-containing fiber to be further widened.

12 Claims, No Drawings

FLAME RETARDANT CLOTH

FIELD OF THE INVENTION

The present invention relates to a flame retardant cloth composed of a composite fiber made from halogen-containing fiber together with polyester fiber, and having an excellent after-handling property and a high flame retardance.

PRIOR ARTS RELATING TO THIS INVENTION

Recently, it has been strongly required of the safety security for human living, and accordingly, necessity of flame retardant raw materials has been closed-up. Under these circumstances, in a field of interior goods, curtains in particular, on top of the flame retardant requirement, requirements for up-graded function such as a higher grade designing by various printing methods, a higher odorless requirement or the like have been risen.

The study for flame retarding of fibers has hitherto been carried out with respect to mixing a conventional flammable fiber with a flame retardant fiber so that flame retardance is additionally given while the superior property of conventional flammable fiber is kept as it is. Particularly, a composite flame retardant fiber product made by blending a high flame retardant fiber with a polyester fiber, which is the most conventional fiber, is very advantageous in aspects of production cost, easy designing and productivity.

However, in such a composite fiber product made by blending a flammable fiber with a high flame retardant fiber, in a pigment printing process in particular, a large amount of flammable binder is inevitably needed to use during its process. As the results, in addition to the problem of flame retardance resided in the said composite fiber product, the final flame retardance after a pigment printing processing is very difficult to be kept at the level of the said composite fiber product. Naturally, commercialized products of this kind have not been appeared in market hitherto.

On the other hand, another conventional technique, which is using a composite fiber consisting of a halogen-containing fiber having a large amount of antimony compound being added in therewith and a polyester fiber, is also not advantageous to use as the common interior materials in aspects of cost and productivity because of using a large amount of flame retardant.

Under these circumstances, the present invention can solve such problems that the extremely lowering of flame retardance in a binder process such as pigment printing process, on top of the flame retardance problem existed in such a composite flame retardant fiber product as in the above-mentioned composite flame retardant fiber consisted of a conventional polyester fiber and a halogen-containing fiber. In further, without adding such a large amount of flame retardant agent as well as with making it advantageous in its productivity, the above-mentioned fiber product can be possible to be applied for a wider field.

DISCLOSURE OF THE INVENTION

The inventors of the present invention had studied intensively to solve the above-mentioned problems. As the results, they found that in the conventional composite fiber product composed of a halogen-containing fiber containing an antimony compound and a polyester fiber, for instance, the problem that its flame retardance is lowered after a pigment printing processing of it can be solved by improving the shrinkage property at high temperature of the above-mentioned halogen-containing fiber containing a antimony compound, namely, even in a case of adding a small amount of the antimony compound, this composite fiber product composed of a halogen-containing fiber and a polyester fiber can maintain its high flame retardance. Continually, the inventors of the present invention achieved to complete this invention.

That is, the present invention is that a flame retardant cloth used as an interior material comprising (A)60–40 parts by weight of fiber which contains 8–70 wt. % of halogen chemically bonded to a polymer and 1–8 wt. % of Sb compound not chemically bonded to a polymer, and which has a shrinkage factor at 240° C. of not less than 40% under a load of 300 mg/metric count yarn count(17), and (B)60–40 parts by weight of polyester fiber, which are compounded making a total of 100 parts by weight.

The fiber(A) to be used for the flame retardant cloth in the present invention has a shrinkage factor at 240° C. of not less than 40%, preferably not less than 60%, under a load of 300 mg/metric count yarn count(17). In case that the shrinkage factor is of less than this range, the flame retardance of the cloth, after a binder processing in particular, becomes difficult to be maintained at high level.

As a process for obtaining the above-mentioned fiber(A) which has a shrinkage factor at 240° C. of not less than 40% under a load of 300 mg/metric count yarn count(17), an improvement for the fiber production process of the said halogen-containing fiber which composes the said fiber(A) is to be necessary. As such improvement of the fiber production process, for example, the polymerization condition of the monomer, the drawing/heat treating conditions in the process for production of the fiber, the additives to be used, or the like, can be mentioned among others for the purpose of making it to exhibit a prescribed heat shrinkage behavior as described in the above. More precisely, as the said improvement, formulation adjustment of the consisting monomers which are composing the polymer to be used for the halogen-containing fiber, adjustment of the polymerization degree, adjustments of the heating up temperature and/or the drawing ratio at the drawing/heat-treating process in the production process for the fiber, in further, blending with a polymer having high heat shrinkage factor, or the like is to be considered. Among them, especially, adjustment of polymerization degree of the polymer to be used for the halogen-containing fiber, in other words, adjusting the specific viscosity of the polymer is effective for improvement of the heat shrinkage behavior. The higher of the specific viscosity makes the higher of the shrinkage factor at 240° C., and the lower of the specific viscosity makes the lower of the shrinkage factor. As methods for adjusting the specific viscosity, in the polymerization process for the polymer to be used for the halogen-containing fiber, a try and error method by changing the ratio of pouring amount of the monomer(s) to pouring amount of the polymerization initiator and simultaneously along with adjusting of the polymerization reaction time, or a method to adjust the pouring amount balance of the chain transfer agent and the catalyst for initiation, or such other methods can be mentioned. On the other hand, as an other method, by blending fiber having such heat shrinkage behavior as well as ability to make the said composite fiber by means of blending with the halogen-containing fiber, which composite fiber exhibits such heat shrinkage behavior as mentioned in the above, that is, by blending fiber with the halogen-containing fiber, for instance, it can be done by blending a polyvinyl alcohol fiber with the halogen-containing fiber. The above-mentioned polyvinyl alcohol fiber is a fiber composed of a polyvinyl alcohol polymer in which 0–60% of the total hydroxyl groups have been formulated, and as its typical example, "Vinylon" (registered trade mark of Kuraray Co.) among others can be mentioned.

The above-mentioned fiber(A) is containing 8–70 wt. % of halogen, preferably 12–45 wt. %. In case that the halogen contents in fiber(A) is less than the above-mentioned range, flame retardance of the fiber is not enough, consequently, flame retardance of the final fiber products made from such fiber is not sufficient, and also, flame retardance of the final fiber product after a pigment printing processing is hard to maintain at a high level. On the other hand, in case that the halogen contents in the fiber(A) is more than the above-mentioned range, the final fiber product made from such fiber and its pigment printed product may become not to be sufficient in aspects of physical property such as strength, heat stability or the like, dyeing property of the fiber, touched feeling and appearance of the final fiber product, and the like. Accordingly, these are not preferable.

As the halogen-containing fiber consisting of the fiber(A) which is containing 8–70 wt. % of the above-mentioned halogen, for example, (a-1) a fiber composed from a copolymer of a halogen-containing monomer and a monomer without containing halogen, (a-2) a composite fiber by blending one or more kinds of fiber composed by a halogen-containing polymer with one or more kinds of fiber composed by a polymer without containing halogen, (a-3) a fiber composed by a polymer which has been prepared by polymerization of a halogen-containing monomer, (a-4) a fiber composed by a polymer-blended compound of a halogen-containing polymer with a polymer without containing halogen, (a-5) a fiber composed by a halogen-containing polymer in which the halogen has been introduced by after-treatment processing, or (a-6) a composite fiber by blending of 2 or more kinds of fibers composed by 2 or more kinds of halogen-containing polymers respectively, or some such others can be mentioned among others. However, the present invention is not limited to these.

As examples of such a halogen-containing polymer which compose the above-mentioned halogen-containing fiber, for example, homopolymers or copolymers of 2 or more kinds of halogen-containing monomers such as vinyl chloride, vinylidene chloride, vinyl bromide and vinylidene bromide; copolymers of a halogen-containing vinyl monomer or a halogen-containing vinylidene monomer and an acrylonitrile monomer such as acrylonitrile-vinyl chloride, acrylonitrile-vinylodene chloride, acrylonitrile-vinyl bromide, acrylonitrile-vinyl chloride-vinylidene chloride, acrylonitrile-vinyl chloride-vinyl bromide and acrylonitrile-vinylidene chloride-vinyl bromide; copolymers of at least one halogen-containing vinyl monomer such as vinyl chloride, vinyl bromide or vinylidene bromide or at least one halogen-containing vinylidene monomer, and acrylonitrile, and at least one vinyl monomer or vinylidene monomer copolymerizable therewith; or a polymer which is composed of an acrylonitrile homopolymer having with a halogen containing compound as an additive or a copolymerized monomer; or halogen-containing polyesters, can be mentioned among others. However, the invention is not limited to these examples. The above-mentioned homopolymers or copolymers may be used alone or in combination of 2 or more kinds at discretion.

As examples of the above-mentioned vinyl monomer or vinylidene monomer copolymerizable with the halogen-containing monomer, for examples, there can be mentioned such as acrylic acid, acrylic acid ester, methacrylic acid, metharylic acid ester, acrylic-amide, methacrylic-amide, vinylacetate, vinylsulfonic acid, vinylsulfonate, methacrylic sulfonic acid, methacrylic sulfonate, styrene-sulfonic acid, styrene-sulfonate can be mentioned among others. They can be used alone or in combination of 2 or more kinds.

As a method to obtain such polymer from the halogen-containing monomer or with the monomer copolymerizable therewith, there is no particular limitation that any of vinyl polymerization methods commonly used such as slurry polymerization method, emulsion polymerization, solution polymerization or the like can be applicable.

As an example of the above-mentioned copolymer for the fiber (a-1) in the above, which has been copolymerized from the halogen-containing monomer and the monomer without containing-halogen, a copolymer which is composed of 30–70 parts by weight of acrylonitrile, 70–30 parts by weight of at least one of the halogen-containing vinyl monomer or the hologen-containing vinylidene monomer, and 0–10 parts by weight of at least one of the vinyl monomer or vinylidene monomer copolymerizable therewith, can be mentioned.

As an example of the above-mentioned composite fiber (a-2) which has been blended at least one of fiber composed of the halogen-containing polymer with one or more kinds of fiber composed of the polymer without containing-halogen, a composite fiber, which has been blended with 40–90 parts by weight of the halogen-containing fiber with containing 20–68 wt. % of halogen and 2.5–2.0 wt. % of antimony compound and 10–60 parts by weight of polyvinyl alcohol fiber therein the composite fiber has been blended to a total of 100 parts by weight, can be mentioned. In further, as an example of the above-mentioned halogen-containing fiber, a fiber composed of a copolymer which has been copolymerized with 30–70 parts by weight of acrylonitrile, 70–30 parts by weight of at least one of halogen-containing vinyl monomer or halogen-containing vinylidene monomer and 0–10 parts by weight of vinyl monomer or vinylidene monomer copolymerizable therewith, can be mentioned.

The above-mentioned fiber(A) used in the present invention contains an antimony compound in addition to the above-mentioned halogen-containing fiber. The antimony compound is an inorganic antimony compound such as antimony trioxide, antimony pentaoxide, antimony acid or antimony oxychloride. They can be used alone or admixture thereof respectively. The contents of such antimony compound is in a range of 1–8 wt. % in the fiber(A), preferably 1–6 wt. %. In a case that the contents of antimony compound is less than 1 wt. % in the fiber(A), the cloth made by blending it with the polyester fiber(B) is hard to exhibit a flame retardance. On the other hand, in a case that the contents of antimony compound is more than 8 wt. % in the fiber(A), it may cause a trouble of clogging in nozzles or blocking of filter clothes installed in a production process, and thus, they make the production cost to be higher. Consequently, they are not preferable. By making the contents of antimony compound not more than 6 wt. %, the production cost and/or the productivity are/is more advantageous.

As processes for the antimony compound to make to be contained in the above-mentioned fiber(A), for example, production methods for the halogen-containing fiber that by admixing the antimony compound within the spinning dope at a process of producing the halogen-containing fiber, and as the other method, by after treatments such as immersing the halogen-containing fiber into an aqueous binder solution containing an antimony compound followed by choking, drying, heating treatment and the like, can be mentioned among others.

In the present invention, as far as the antimony compound contents being contained in the polymer is kept at level in a range of 8–70 wt. %, using other flame retardant agent in combination with the said antimony compound may be useful as well. As such other flame retardant agents, for example, halide aromatic compounds such as hexabromobenzene, halide aliphatic compounds such as chloro-paraffine, halogen-containing phosphorus compounds such as tris(2,3-dichloropropyl)phosphate, organic phosphorus compounds such as dibutylaminophosphate, inorganic phosphorus compounds such as poly-ammonium-phosphate, inorganic magnesium compounds such as MgO, $Mg(OH)_2$ and $MgCO_3$, inorganic stannous compounds such as stannic oxide, meta-stannic acid, oxy-halogenated tin and hydroxyl tin, can be mentioned among others.

In next, as the polyester fiber(B) to be used in the present invention, a generally used polyester fiber composed of mainly polyethylene-terephthalate can be usable. As such polyester fibers, there are regular-type fiber, after-treated fiber, specially treated fiber such as newly developed synthetic fiber, and the like.

The flame retardant cloth related to the present invention is produced by blending of 60–40 parts by weight of the fiber(A) described as in the above and with 60–40 parts by weight of the fiber(B) as in the above-mentioned, in which the total parts by weight of the fiber(A) and fiber(B) is made to become 100 parts by weight. In case that the contents of the above-mentioned fiber(A) is less than 40 parts by weight, the flame retardance of the cloth is not enough, and in case that the contents of the fiber(A) is more than 60 parts by weight, characteristics of the polyester fiber of itself such as heat durability and whiteness may be deteriorated. As a typical production method of the cloth which has been made by blending with the above-mentioned fiber(A) and the polyester fiber(B), the cloth is obtainable by that a spinning fiber is prepared at first by blending with the fiber(A) and (B), then the spinning fiber is provided for making a cloth, material, knitting or the like, or, the cloth can be obtainable by weaving of admixture fiber which has been prepared by blending a spinning fiber or filament made from the fiber(A) with a spinning fiber or filament made from the fiber(B), or, obtainable by weaving the fiber(A) and (B) alternatively.

BEST MODE FOR CARRYING OUT THE INVENTION

Hereinafter, the present invention will be described in more detail by way of the following Examples, but the invention is not limited to the following Examples. Before describing the Examples, measuring method being used for shrinkage factor of the fiber, and evaluation method being used for flame retardance of the cloth, are shown as follows.

(Measurement of Shrinkage Factor at 240° C.)

Thermal analysis instrument (TMA/SS150C with using SSC500H of its connecting station; trade name of Seiko Electronics Co.) was used for the measurement of shrinkage factor of the fiber at 240° C.

The states of specimen used for the measurement were as follows;

5 mm of specimen length with using the spinning fiber of metric count yarn count(17) was used; and measuring condition was set that under a load of 300 mg, at 100° C./min. of heating up rate for the heating chamber, and at 100 ml/min. inlet flow rate of nitrogen gas; then, the specimen length change between before and after heating was measured, therein the heating was carried out from 50° C. of the specimen temperature until raised up to 350° C. of the same. From the chart obtained, the shrinkage factor at 240° C. was determined.

(Evaluation of Flame Retardance)

The evaluation procedure for flame retardance of the cloth was carried out according to Method A-1 of JIS L 1091 standard which is a measuring method by sagging in using micro-burner method, and which method is regulated in the fire prevention inspection standard 45°. Washing of the cloth was not done in this procedure. Burning directions of the cloth were 4 directions of the specimen which were length, width, surface and under-surface directions of the specimen. And a total average value of the burned length of each of the above-mentioned directions was used for the comparison evaluation. The shorter the burned length is considered to be the higher flame retardant. In this evaluation, in case that even one of the 4 specimens for each of the above-mentioned 4 directions was burned out completely, that is, burning out until the sustaining frame of the cloth specimen, it was counted to be completely burned out due to unable to measure the burned length for determination of the average value.

(EXAMPLE 1 AND COMPARATIVE EXAMPLE 1)

(1) Preparation of the Halogen-Containing Fiber

(1—1) Example 1

8 parts by weight of acrylonitrile, 92 parts by weight of vinyl chloride, 1.5 parts by weight of sodium-laurylsulfate, 310 parts by weight of water, 1 part by weight of ammonium-persulfate and 0.4 parts by weight of dodecyl-mercaptan were poured into an autoclave, and the polymerization reaction was carried out at 50° C. for 18 hours by keeping continuous addition of acrylonitrile at a rate of 1.57 parts by weight/hour.

Composition of the polymer obtained was; 45.5 parts by weight of acrylonitrile, 54 parts by weight of vinyl chloride; and halogen contents in the polymer was 30.7 wt.; and relative viscosity of 0.2 wt. % solution of it in cyclohexanone was 0.30.

Into a 20 wt. % of the above-mentioned polymer solution in acetone, 5 parts by weight of antimony trioxide was added, thus the spinning solution was prepared. With using a nozzle die in which each nozzle hole diameter was 0.08 mm and set in 300 of such nozzle holes, the above-mentioned spinning solution was extruded through the nozzle die into a 30 wt. % of acetone aqueous solution at 25° C., and then, after washing with water, the extruded fiber was dried at 120° C. for 8 minutes. After then, it was drawn up to three times long at 120° C., and was heat-treated at 150° C. for 5 minutes. By these processes, a halogen-containing fiber, of which denier (hereinafter, describing as "d") was 2d, was obtained. An oily finishing agent for spinning was attached to the above-mentioned fiber, and then, a crimp was given to it. The fiber obtained by thus processing was cut out to 51 mm length. With using this cut out fiber, the spinning was carried out under a load of metric count yarn count of 17.

(1–2) Comparative Example 1

7 parts by weight of acrylonitrile, 89 parts by weight of vinyl chloride, 1.1 parts by weight of sodium-laurylsulfate, 400 parts by weight of water, 0.8 parts by weight of sodium bisulfite, 0.5 parts by weight of sulfurous acid, 0.002 parts by weight of ferrous oxide 7 hydrate and 0.06 parts by weight of ammonium-persulfate were poured into an autoclave, and the polymerization reaction was carried out at 40° C. for 6 hours by keeping continuous addition of acrylonitrile at a rate of 7.7 parts by weight/hour, and also, continuous addition of ammonium-persulfate at a rate of 0.04 parts by weight/hour.

Composition of the polymer obtained was ; 44.5 parts by weight of acrylonitrile, 55 parts by weight of vinyl chloride; and halogen contents in the polymer was 31.5 wt. %; and relative viscosity of 0.2 wt. % solution of it in cyclohexanone was 0.16.

Into a 25 wt. % of the above-mentioned polymer solution in acetone, 5 parts by weight of antimony trioxide was added, thus the spinning solution was prepared. With using a nozzle die in which each nozzle hole diameter was 0.08 mm and set in 300 of such nozzle holes, the above-mentioned spinning solution was extruded through the nozzle die into a 30 wt. % of acetone aqueous solution at 25° C., and then, after washing with water, the extruded fiber was dried at 120° C. for 8 minutes. After then, it was drawn up to three times long at 120° C., and was heat-treated at 150° C. for 5 minutes. By these processes, a halogen-containing fiber, of which denier was 2d, was obtained. An oily finishing agent for spinning was attached to the above-mentioned fiber, and then, a crimp was given to it. The fiber made by thus processing was cut out to 51 mm length. With using this cut out fiber, the spinning was carried out under a load of metric count yarn count of 17.

(2) Preparation of the Cloth 130 wooly fibers/inch, with using a polyester fiber of which denier was 150d, were used as warp fiber, and 40 spinning fibers/inch, with using the fiber obtained by Example 1 or Comparative Example 1 independently described in the above (1), were used as weft fiber. And, the cloth was prepared by the above-mentioned fabrics production process. The blended ratio of the polyester fiber to the spinning fiber in the above-mentioned cloth was 48/52.

The pigment printing processing was carried out by that a solution, which was composed of; 97 parts by weight of an acrylic-acid ester typed binder, 2 parts by weight of a cross-linking agent for pigment printing and 1 part by weight of a pigment for pigment printing, was attached to the cloth, therein the attaching was made in manner that the weight ratio of the solution amount to the cloth was kept to be 5 parts by weight of the attaching solution per 100 parts by weight of the cloth. Then, the cloth was dried at 110° C. for 2 minutes, thereafter it was heat-treated at 130° C. for 3 minutes.

Halogen-containing amount, antimony trioxide-containing amount, the relative viscosity of the polymer and the shrinkage factor at 240° C. of the spinning fibers obtained by the above-mentioned Example 1 and Comparative Example 1 respectively, are shown in Table 1 below. And also, the flame retardance of each of the above-mentioned clothes which were taken from before and after the pigment printing processing, was evaluated, and the results are shown in Table 1 as well.

TABLE 1

| | halogen-containing fiber (spinning fiber) | | | | evaluation result of flame retardance pigment printing processing | |
|---|---|---|---|---|---|---|
| | halogen-containing amount (wt. %) | antimony containing amount (wt. %) | viscosity of the polymer | shrinkage factor at 240° C. (%) | yes (after) | no (before) |
| Example 1 | 29.2 | 4.7 | 0.30 | 78 | 4.8 cm | 3.3 cm |
| Comparative Example 1 | 29.9 | 4.7 | 0.16 | −14 (*1) | totally burned | 4.2 cm |

(*1) (−) mark means "not shrinking but elongating".

As clearly seen from Table 1, the cloth of Example 1, which was using the spinning fiber having not less than 40% of shrinkage factor at 240° C. and being composed of a halogen-containing fiber containing an antimony compound, shows a high flame retardance despite of whether a pigment printing processing being done or not done. On the other hand, even a halogen-containing fiber containing an antimony compound is used as same as in Example 1 though, the cloth of Comparative Example, which was prepared with using a spinning fiber of which shrinkage factor was not more than 40% at 240° C., is inferior to the cloth of Example 1 in the flame retardance. In further, by the pigment printing processing, flame retardance of the cloth of Comparative Example 1 was remarkably lowered, consequently, a total burning out of the cloth was occurred. Accordingly, even a halogen-containing fiber having a similar composition and containing a flame retardant agent as well, by the spinning fiber having a different shrinkage factor at 240° C., a composite cloth blended with a polyester fiber and the said fiber is largely affected for its flame retardance level.

(Example 2,3 and Comparative Example 2)

(1–1) Example 2

10.7 parts by weight of acrylonitrile, 4.4 parts by weight of vinylidene chloride, 1.1 parts by weight of sodium-laurylsulfate, 0.3 parts by weight of sulfurous acid gas, 0.00033 parts by weight of ferrous oxide, 0.085 parts by weight of mercaptoethanol, 0.0115 parts by weight of ammonium-persulfate and 200 parts by weight of water were poured into an autoclave, and the polymerization reaction was carried out at 50° C. for 4 hours and 30 minutes, therein, during a period from the starting time until 4 hours and 20 minutes from the starting, 42.6 parts by weight of acrylonitrile, 40.9 parts by weight of vinylidene chloride, 1.4 parts by weight of sodium styrene-sulfonate and 0.13 parts by weight of ammonium-persulfate were added with keeping a constant addition rate equivalently as well as continually.

The polymer obtained was composed of 51.7 parts by weight of acrylonitrile, 46.6 parts by weight of vinylidene chloride, and 34.1 wt. % of halogen contained. The relative viscosity of 0.2 wt. % of the polymer solution in dimethylformamide was 0.32.

The copolymer obtained was solved in dimethylformamide to be adjusted to 28 wt. % of its resin concentration. 0.9 parts by weight of glycidyl methacrylate and 3 parts by weight of antimony trioxide against to 100 parts by weight of the resin in this solution were added, and made the solution to be the spinning solution. With using a nozzle die in which each nozzle hole diameter was 0.08 mm and set in 300 of such nozzle holes, the above-mentioned spinning solution was extruded through the nozzle die into a 55 wt. % of dimethylformamide aqueous solution, and then, after washing with water, the extruded fiber was dried at 130° C. for 3 minutes. After then, the extruded fiber was drawn up to three times long, and was heat-treated with steam at 120° C. for 3 minutes. Continually, an oily finishing agent for spinning was attached to the above-mentioned fiber, and then, after a crimp being given to it, the fiber made by thus processing was cut out to 51 mm length. Halogen contents in the fiber obtained was 33.1 wt. %. This cut halogen-containing fiber was made spinning under a load of metric count yarn count of 17.

(1–2) Example 3

8.5 parts by weight of acrylonitrile, 6.5 parts by weight of vinylidene chloride, 1.1 parts by weight of sodium-laurylsulfate, 0.3 parts by weight of sulfurous acid gas, 0.00025 parts by weight of ferrous oxide, 0.0315 parts by weight of 2-mercaptoethanol, 0.0115 parts by weight of ammonium-persulfate and 200 parts by weight of water were poured into an autoclave, and the polymerization reaction was carried out at 50° C. for 4 hours and 30 minutes, therein, during a period from the starting time until 4 hours and 20 minutes from the starting, 44.8 parts by weight of acrylonitrile, 38.8 parts by weight of vinylidene chloride, 1.4 parts by weight of sodium styrene-sulfonate and 0.13 parts by weight of ammonium-persulfate were added with keeping a constant addition rate equivalently as well as continually.

The resin obtained was composed of 51.2 parts by weight of acrylonitrile, 47.4 parts by weight of vinylidene chloride, and 34.7 wt. % of halogen contained. The relative viscosity of 0.2 wt. % of the resin solution in dimethylformamide was 0.43.

The copolymer obtained was solved in dimethylformamide to be adjusted to 25 wt. % of its resin concentration. 0.9 parts by weight glycidyl methacrylate and 3 parts by weight of antimony trioxide against to 100 parts by weight of the resin in this resin solution were added, and made the solution to be the spinning solution. With using a nozzle die in which each nozzle hole diameter was 0. 08 mm and set 300 of such nozzle holes, the above-mentioned spinning solution was extruded through the nozzle die into a 55 wt. % of dimethylformamide aqueous solution, and then, after washing with water, the extruded fiber was dried at 130° C. After then, the extruded fiber was drawn up to three times long, and was heat-treated with steam at 120° C. for 3 minutes, thereafter, an oily finishing agent for spinning was attached to the above-mentioned fiber, and then, after a crimp being given to it, the fiber made by thus processing was cut out to 51 mm length. Halogen contents in the fiber obtained was 33.7 wt. %. This cut fiber was made spinning under a load of metric count yarn count of 17.

(1–3) Comparative Example 2

11 parts by weight of acrylonitrile, 4.5 parts by weight of vinylidene chloride, 1.1 parts by weight of sodium-laurylsulfate, 0.166 parts by weight of sodium bisulfate, 0.13 parts by weight of sulfurous acid gas, 0.002 parts by weight of ferrous oxide, 0.0907 parts by weight of 2-mercaptoethanol, 0.0115 parts by weight of ammonium-persulfate and 200 parts by weight of water were poured into an autoclave, and polymerization reaction was carried out at 55° C. for 6 hours and 10 minutes, therein, during a period from the starting time until 6 hours from the starting time, 43.8 parts by weight of acrylonitrile, 42 parts by weight of vinylidene chloride, 1.2 parts by weight of sodium styrene-sulfonate and 0.135 parts by weight of ammonium-persulfate were added with keeping a constant addition rate equivalently as well as continually.

The resin obtained was composed of 52.2 parts by weight of acrylonitrile, 46.3 parts by weight of vinylidene chloride, and 33.9 wt. % of halogen contained. The relative viscosity of 0.2 wt. % of the resin solution dimethylformamide was 0.21.

The copolymer obtained was solved in dimethylformamide to be adjusted to 30 wt. % of its resin concentration. 0.9 parts by weight of glycidyl methacrylate and 3 parts by weight of antimony trioxide against 100 parts by weight of the resin in this resin solution were added, and made the solution to be the spinning solution. With using a nozzle die in which each nozzle hole diameter was 0.08 mm and set 300 of such nozzle holes, the above-mentioned spinning solution was extruded through the nozzle die into a 55 wt. % of dimethylformamide aqueous solution, and then, after washing with water, the extruded fiber was dried at 130° C. After then, the extruded fiber was drawn up to three times long, and was heat-treated with steam at 120° C. for 3 minutes, thereafter, an oily finishing agent for spinning was attached to the above-mentioned fiber, and then, after a crimp being given to it, the fiber made by thus processing was cut out to 51 mm length. Halogen contents in the fiber obtained was 32.9 wt. %.

This cut fiber was made spinning under a load of metric count yarn count of 17.

(3) Preparation of the Cloth 130 wooly fibers/inch, with using a polyester fiber of which denier was 150d, were used as warp fiber, and 40 spinning fibers/inch, with using the fiber obtained by Example 2, Example 3 or Comparative Example 2 independently described in the above (1), were used as weft fiber. And, the cloth(2/2 twill weave) was prepared by the above-mentioned fabrics production process. The flame retardance evaluation was carried out on each of these fibers in cases of before and after the pigment printing processing as in the same manner as described in Example 1. The results are shown in Table 2 in below. The blended ratio of the polyester fiber to the spinning fiber in the above-mentioned each of clothes was 48/52.

TABLE 2

| | halogen-containing fiber (spinning fiber) | | | | evaluation result of flame retardance pigment printing processing | |
|---|---|---|---|---|---|---|
| | halogen-containing amount (wt. %) | antimony containing amount (wt. %) | viscosity of the polymer | shrinkage factor at 240° C. (%) | yes (after) | no (before) |
| Comparative Example 2 | 32.9 | 2.9 | 0.21 | 35 | totally burned | totally burned |
| Example 2 | 33.1 | 2.9 | 0.32 | 50 | 6.3 cm | 8.2 cm |
| Example 3 | 33.7 | 2.9 | 0.43 | 63 | 3.7 cm | 5.6 cm |

(EXAMPLES 4 and 5, & COMPARATIVE EXAMPLE 3 and 4)

(1) Preparation of the Halogen-Containing Fiber (1—1) Comparative Example 3

With using the same condition as in Comparative Example 1 except 6 parts by weight of antimony trioxide was added against to 100 parts by weight of the resin, a 51 mm length of cut fiber containing antimony trioxide was prepared. This cut fiber was made spinning under a load of metric count yarn count of 17, and then, obtained the fiber product.

(1–2) Example 4 & 5, Comparative Example 4

A 51 mm length of cut fiber which was similar to the fiber described in the above-mentioned Comparative Example 3, was blended with a 51 mm length cut of polyvinyl alcohol fiber (Vinylon: registered trade mark, made by Kuraray Co.) of which blending amount was 25, 50 and 75 parts by weight respectively in making 100 parts by weight of its total amount on each of them, by these means, 3 kinds of spinning fiber being classified in the metric count yarn count of (17) were prepared. And each of these 3 kinds of fiber was presented as Example 4, Example 5 or Comparative Example 4 respectively.

(2) Preparation of the Cloth

The clothes were prepared by the above-mentioned fabrics production process, wherein 130 wooly fibers/inch, with using a polyester fiber of which denier was 150d, were used as warp fiber, and 40 spinning fibers/inch, with using each of the above-mentioned spinning fibers, were used as weft fiber. And, the flame retardance evaluation was carried out on each of these fibers in cases of before and after the pigment printing processing as in the same manner as described in Example 1. The results are shown in Table 3 in below. The blended ratio of the polyester fiber to the spinning fiber in the above-mentioned each of clothes was 48/52.

TABLE 3

| | halogen-containing fiber (spinning fiber) | | | | evaluation result of flame retardance pigment printing processing | |
|---|---|---|---|---|---|---|
| | blended ratio of the vinylon (parts by weight) | halogen-containing amount (wt. %) | antimony-containing amount (wt. %) | shrinkage factor at 240° C. | yes (after) | no (before) |
| Comparative Example 3 | 0 | 29.7 | 5.6 | −11 (*1) | totally burned | 4.2 cm |
| Example 4 | 25 | 22.3 | 4.2 | 79 | 3.9 cm | 3.9 cm |
| Example 5 | 50 | 14.9 | 2.8 | 78 | 5.1 cm | 3.6 cm |
| Comparative Example 4 | 75 | 7.4 | 1.4 | 68 | totally burned | totally burned |

(*1) (−) mark means "not shrinking but elongating".

As shown in Table 3, in Example 4 and Example 5, notwithstanding that the halogen-containing amount in the spinning fiber composed of halogen-containing fiber and the containing amount of the antimony compound are less than these in Comparative Example 3 respectively, by means of blending with a polyvinyl alcohol fiber, of which shrinkage factor at 240° C. can be increased up to 40% or more. Consequently, the cloth, which has been prepared by blending the said fiber together with a polyester fiber, is possibly able to exhibit a high flame retardant property whichever a pigment printing processing has been done on the cloth or not been done. On the other hand, the cloth in Comparative Example 3, the shrinkage factor at 240° C. of the spinning fiber composed of a halogen-containing fiber is not more than 40%, and the cloth prepared by blending this spinning fiber with a polyester fiber is worse in flame retardance than the clothes in Example 4 and Example 5, and accordingly, of which flame retardant property is decreasing remarkably after a pigment printing processing has been done. In further, in case of Comparative Example 4, although the shrinkage factor at 240° C. of spinning fiber composed of a halogen-containing fiber is not less than 40% as same as in the cases of Examples, because of a smaller amount of the contained halogen, the cloth which has been blended the said fiber with a polyester fiber will not be satisfactory in the flame retardant property whichever a pigment printing processing is done or not done.

From the results shown in Table 1 to Table 3, by means of improving the shrinkage factor at a high temperature of the halogen-containing fiber containing antimony compound, the cloth which is prepared by blending the said halogen-containing fiber with a polyester fiber will exhibit a high flame retardant property, and the effect of the present invention is clearly shown in these Examples.

INDUSTRIAL APPLICABILITY

The flame retardant cloth of the present invention is having a high flame retardant property, and also, even after a pigment printing processing of it, the high flame retardant property will be maintained. Accordingly, a composite flame retardant fiber product which has been prepared by blending the said halogen-containing fiber together with a polyester fiber can be applicable to more various fields.

What is claimed is:

1. A flame retardant cloth comprising (A)60–40 parts by weight of fiber which contains 8–70 wt. % of halogen chemically bonded to a polymer and 1–8 wt. % of Sb compound not chemically bonded to a polymer, and which has a shrinkage factor at 240° C. of not less than 40% under a load of 300 mg/metric count yarn count (17), and (B)60–40 parts by weight of polyester fiber, which are compounded making a total of 100 parts by weight.

2. The flame retardant cloth of claim 1, wherein the above mentioned fiber (A) of claim 1 is a halogen-containing fiber composed of a copolymer which has been copolymerized with a halogen-containing monomer and a nonhalogen-containing monomer.

3. The flame retardant cloth of claim 2, wherein the above mentioned copolymer which is composed of 30–70 parts by weight of acrylonitrile, 70–30 parts by weight of at least one halogen-containing vinyl monomer or halogen-containing vinylidene monomer, and copolymerized with said copolymer 0–10 parts by weight of at least one of vinyl monomer or vinylidene monomer.

4. The flame retardant cloth of claim 1, wherein the above-mentioned fiber (A) is a complete fiber blended a halogen-containing fiber, which is composed of one or more kinds of halogen-containing polymer, together with a fiber which is composed of one or more kinds of a non-halogen containing polymer.

5. The flame retardant cloth of claim 4, wherein the above-mentioned fiber (A) is a composite fiber blended a halogen-containing fiber, which contains 20–68 wt % of halogen and 2.5–20 wt. % of antimony compound, together with 10–60 parts by weight of a polyvinyl alcohol fiber in making a total of 100 parts by weight.

6. The flame retardant cloth of claim 5, wherein the above mentioned halogen-containing fiber is a fiber made from a copolymer which is composed of 30–70 parts by weight of acrylonitrile, 70–30 parts by weight of at least one of halogen-containing vinyl monomer or halogen-containing vinylidene monomer, and copolymerized with said copolymer 0–10 parts by weight of at least one of vinyl monomer or vinylidene monomer.

7. The flame retardant cloth of claim 1, wherein the fiber (A) is a fiber made from a polymer which has been prepared by polymerization of a halogen-containing monomer.

8. The flame retardant cloth of claim 1, wherein the fiber (A) is a fiber made from a polymer-blended resin compound of a polymer, which has been prepared by polymerization of a halogen-containing monomer, together with non-halogen containing polymer.

9. The flame retardant cloth of claim 1, wherein the above-mentioned fiber(A) is a fiber made from a halogen-containing polymer in which the halogen has been introduced into the polymer by a post-treatment process.

10. The flame retardant cloth of claim 1, wherein the above-mentioned fiber (A) is a composite fiber blended from 2 or more kinds of fiber, in which each of these fibers is composed of a different kind of halogen-containing polymer.

11. A method of improving flame retardant cloth comprising:

providing a flame retardant cloth comprising (A) 60–40 parts by weight of fiber which contains 8–70 wt. % of halogen chemically bonded to a polymer and 1–8 wt. % of Sb compound not chemically bonded to a polymer, and (B) 60–40 parts by weight of polyester fiber, which are compounded making a total of 100 parts by weight and, treating the flame retardant cloth such that the cloth has a shrinkage factor at 240° C. of not less than 40% under a load of 300 mg/metric count yarn count (17).

12. The method of claim 11, wherein the flame retardant cloth can be treated to achieve the desired heat shrinkage factor by adjusting the polymerization degree of the polymer, adjusting the heating temperature, adjusting the drawing ratio of the fiber or blending the composition with a polymer having a high shrinkage factor.

* * * * *